US007527265B1

(12) United States Patent
Berman

(10) Patent No.: US 7,527,265 B1
(45) Date of Patent: May 5, 2009

(54) DICE GAME

(75) Inventor: Lyle Berman, Minnetonka, MN (US)

(73) Assignee: Lakes Entertainment, Inc., Minnetonka, MN (US)

( * ) Notice: Subject to any disclaimer, the term of this patent is extended or adjusted under 35 U.S.C. 154(b) by 115 days.

(21) Appl. No.: 11/173,570

(22) Filed: Jul. 1, 2005

Related U.S. Application Data

(60) Division of application No. 09/975,907, filed on Oct. 12, 2001, and a continuation-in-part of application No. 09/975,907, filed on Oct. 12, 2001, now Pat. No. 6,913,262.

(51) Int. Cl.
*A63F 1/04* (2006.01)
*A63F 1/00* (2006.01)

(52) U.S. Cl. ..... 273/274; 273/309; 273/292

(58) Field of Classification Search ..... 273/274, 273/309, 292; 463/16, 17, 22, 12, 13
See application file for complete search history.

(56) References Cited

U.S. PATENT DOCUMENTS

| | | | | |
|---|---|---|---|---|
| 6,070,872 | A * | 6/2000 | Squitieri | 273/292 |
| 2001/0042960 | A1* | 11/2001 | Lewis et al. | 273/274 |
| 2003/0032471 | A1* | 2/2003 | Darder | 463/16 |

* cited by examiner

*Primary Examiner*—Benjamin H Layno
(74) *Attorney, Agent, or Firm*—Dorsey & Whitney LLP; Devan V. Padmanabhan

(57) ABSTRACT

A method of dealing a card game is taught wherein cards are used in place of dice. The cards are dealt to locations on a table and a randomizing event is used to select from one or more of the dealt cards which appear on a gaming table. To allow the player to exercise some control, one or more cards are selected to determine a roll utilizing a random method; such as dice, a spinning wheel, selection of a space at random or a random number generator. A method is used to select a card based on the selection of the space on which the card is dealt. A method of dealing a card game is taught wherein cards representing dice having a least four sides are utilized using variations of rules for games such as 1) traditional craps game, 2) Four The Money game, 3) high low craps, or 4) roulette. By repeatedly shuffling either two sets of six cards numbered 1 through 6, or one set of 36 cards (representing all of the rolls of a set of two six sided dice) traditional craps rules may be followed. Also taught is a roulette game which is played by having cards representing the numbered slots of a roulette wheel and roulette table. A user is allowed to pre-select a space from a plurality of spaces into which a pre-determined number of cards are dealt in order to determine the number generated in place of a dice roll to allow user interaction in the random decision. Electronic monitor card numbers, storage of card numbers, and the display of prior outcomes is also possible. Comparison of the stored information to wagers is made to determine when wagers are won.

17 Claims, 7 Drawing Sheets

DICE GAME

This patent is a divisional and continuation in part patent of U.S. Utility patent application Ser. No. 09/975,907 filed Oct. 12, 2001 now U.S. Pat. No. 6,913,262.

BACKGROUND OF THE INVENTION

1. Field of Invention

The invention relates to card games using the generation of numbers between a predetermined minimum and a predetermined maximum, such as craps, Four the Money, hi-low craps and roulette. More particularly the invention applies to playing a game of the type previously listed utilizing a card deck to generate random rolls and providing for unique features of tracking and displaying the results.

2. Prior Art

Dice games and card games are known in the prior art. Machines which automatically deal from decks and which randomly deal from a certain position in a deck of cards are also known in the art.

GENERAL DESCRIPTION

One of the major improvements of the invention versus the prior art is the addition of a randomizing event to select from one or more pre-dealt cards which appear on a gaming table.

While the act of displaying cards in and of itself is not novel, it is novel in order to allow the player to exercise some control utilizing an alternative selection means in order to select from one or at least one of several different cards so that a mechanical device generating the roll is not the sole arbitrator of the cards selected and the roll generated by the selection.

The invention described herein is best understood as a novel method of playing and redesigning roulette or dice games (e.g. craps, Four The Money, High-Low Craps, etc.) by substituting numbered cards for traditional dice and utilizing modern shuffling technology and unique layouts to provide better, random results.

A technique for playing a wagering game is taught where at least one random number is needed in order to determine an outcome and wherein the number is determined by selecting at least one or more random numbers within a range and where the numbers are determined by mechanically dealing one or more cards where each card has at least two numbers or has a single number representing a plurality of numbers (alternatively, at least two cards are dealt and added together to get the result). One of the cards be replaced or selected with a dice or dice means to vary the result.

One method of doing this would be to shuffle multiple sets of six cards where each set was numbered sequentially one through six so that the shuffle and subsequent deal acts numerically identically (statistically) to a six-sided dice.

A shuffling machine could shuffle the cards so that the sets of six would be shuffled together and could use random card selection technologies to randomly deal from the mixed decks. Modern shuffling technology for normal card decks may be adapted for these options.

The dealer could (1) deal out two or more (even all six cards) and turn over one for each dice or (2) deal out one of the 6 cards for each dice. In order to add various degrees of excitement, by way of example, the six cards could be set down in two rows of six each and then one card from each row could be turned up in order to get a dice roll for a game of craps, Four The Money, or High-Low Craps. To give the player the feeling of control, the deal need only deal two cards from which the selection of the player would be made since this would introduce a randomizing feature without dependence on a machine, but would reduce the number of cards to be handled. Also, the display of the non-picked card could add to the angst which makes these games of chance so popular.

Likewise, only one of the cards could be dealt out with a set of thirty-six cards (each representing a roll of two dice) and that card could be the dice roll.

The two card method (2 sets of 1-6) could be set up so that a user could look at the six dealt cards dealt face down and select one to be turned up. To prevent marking, the players could select one space of 6 and the card dealt to that space would be the one turned up. In order to provide more excitement, it could be required that one player would select one card location and another player would select a second card location where two players were playing the game. If only one player were to play in the game, various similar methods of selecting the cards automatically could be established. In the preferred embodiment two six-sided dice are used. It can be seen that any number of dice sides or dice numbers could be utilized to a similar effect.

For Roulette, two extra cards would be required representing 0 and 00 in addition to the other card numbers (traditionally 1-36) possible from a roulette wheel. This would be played on a prior art table being modified to receive 2 or more numbers which would e available for the user to select using the methods described herein.

Under another method to practice to the invention where the outcome of two six sided dice are important, the game would be played having at least one of 36 cards dealt out reflecting the 36 combinations of two six sided dice and the dealer would turn one card up in order to represent the dice roll of the two dice. In one embodiment, all 36 dice could be shuffled and one or more dealt out of the set of 36 with a space selection being made before the deal. The same machine or a second machine with a like dice set (or with a more unusual game with a different type of dice set) could deal the next deal in a similar manner. Dice could be dealt from countless decks and recycled according to logical dealing sequences. Solid cards are envisioned, but electronic displays representing the cards could be used. These displays could be electronically hidden by cards.

In one embodiment of the invention, all 36 combinations could be dealt and the players could pick rolls sequentially so that each time one was picked it was turned over. For Four The Money or High-Low Craps type games, this would allow the user to obtain a win or a loss based on (1) 4 cards without a seven, or (2) how many of the cards were turned up before a target number, usually seven with two six-sided dice, having 36 possible combinations. The selection process can involve a random selection means (dice means, wheel, etc.)

A craps game may be set up so that the players sequentially take turns so that multiple players select cards to turn up, where one player turns up the cards until a terminating event (a seven after a point in traditional craps) or cards may be electronically selected to be turned up.

Because multiple cards are used in the invention, each card may be electronically or mechanically marked so that a sensor can determine what number is displayed. In this way, electronics may track the card displayed or the total displayed to track a series of card plays so that in games where multiple rolls or totals are required (four the money or high roller of the month, for example) or series of rolls are important (different doubles, all or none at all), these may be tracked electronically. This is more difficult in traditional dice usage because the dice must be picked up and set on a location or number punched in for the same result. Here the cards need only be placed at the appropriate location when dealt.

It is therefore one purpose of the invention to provide for a game which follows rules of various gaming-type dice games utilizing cards and utilizing a novel method of shuffling, dealing and displaying the cards in order to attempt to maintain the statistical variation in existing dice games and in order to provide new rules allowing for greater player entertainment and selection.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE INVENTION

Figure 1:
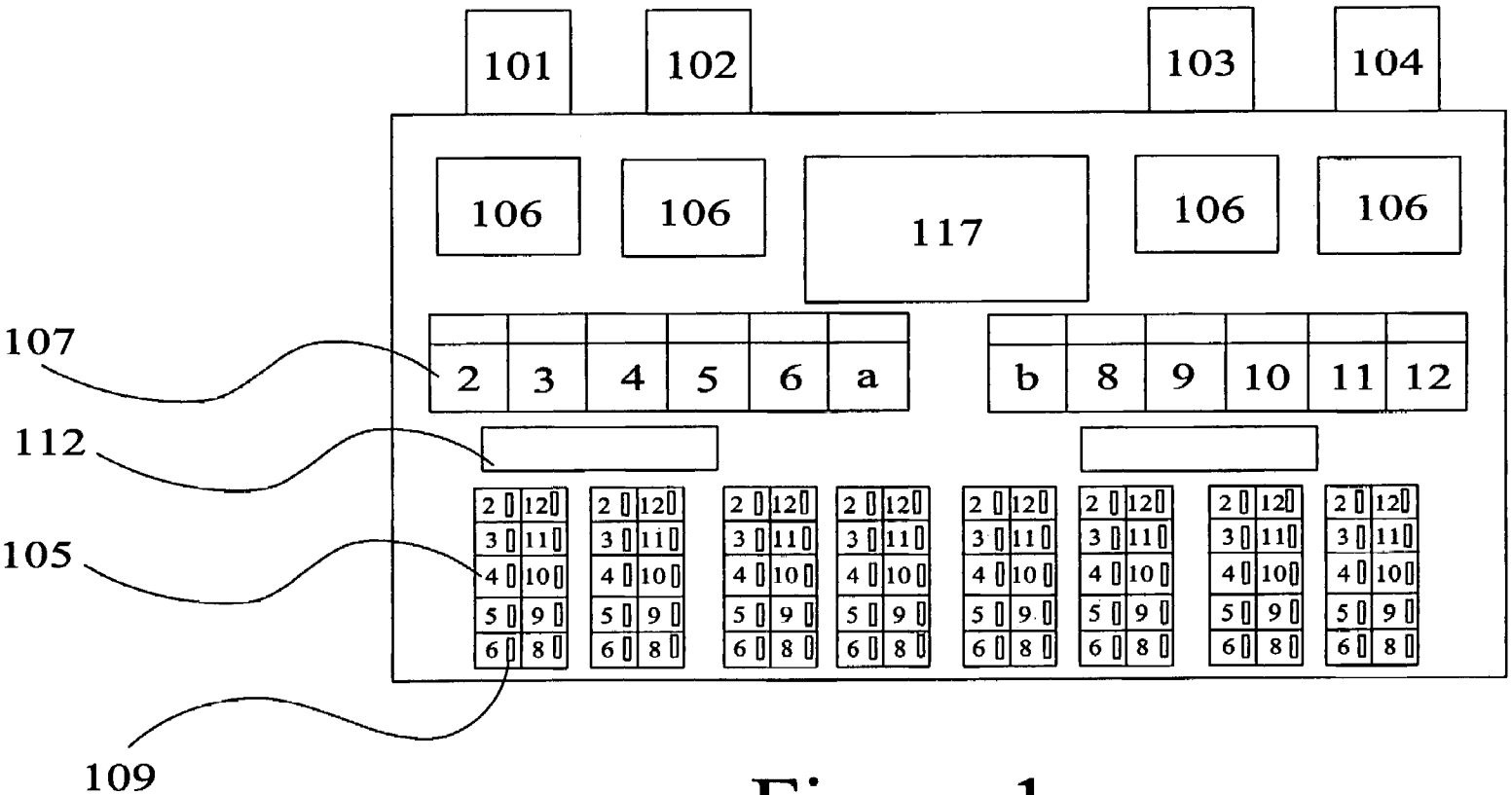
FIG. 1 shows a layout for the preferred embodiment showing a plurality of dealing machines although only a single dealing machine is necessary to practice the invention.

As can best be seen by reference to FIG. 1 in the preferred embodiment there are four card dealing machines 101 through 104.

In front of each of these, is a space, card holding location 106 to receive one or more cards. Betting locations are available on the table. One betting location 107 which is here shown as a traditional odds wager location, which is typically served exclusively by the dealer. Also shown are user betting locations 105, here a Four The Money odds wager layout. Here, the odds wager layout shows slots 109 for wagers to be placed and held. These slots 109 may not take the money; they may simply serve to hold the wager until the end of the betting period to prevent manipulation of wagers or to prevent these wagers from being disturbed by dice rolls. The slots 109 may also allow the house to track which bets have been made so that the game can identify winning wager and losing wagers by lighting the space when a win or loss occurs to ease the handling of multiple wagers of this type. While slots 109 are shown for this purpose, it is also clear that these slots 109 could be replaced with sensors of other types which sense the presence of a wager at the locations where the slots 109 are shown.

Each wager location allows the player a place to put a wager on a place to put a wager on a statistical event. For example, a "come bet" allows a wager that a 7, 11 or repeat of a point will occur before a "craps" roll on the "come out" roll or a 7 after the "come out" roll but before the repeat of the point.

Figure 2:
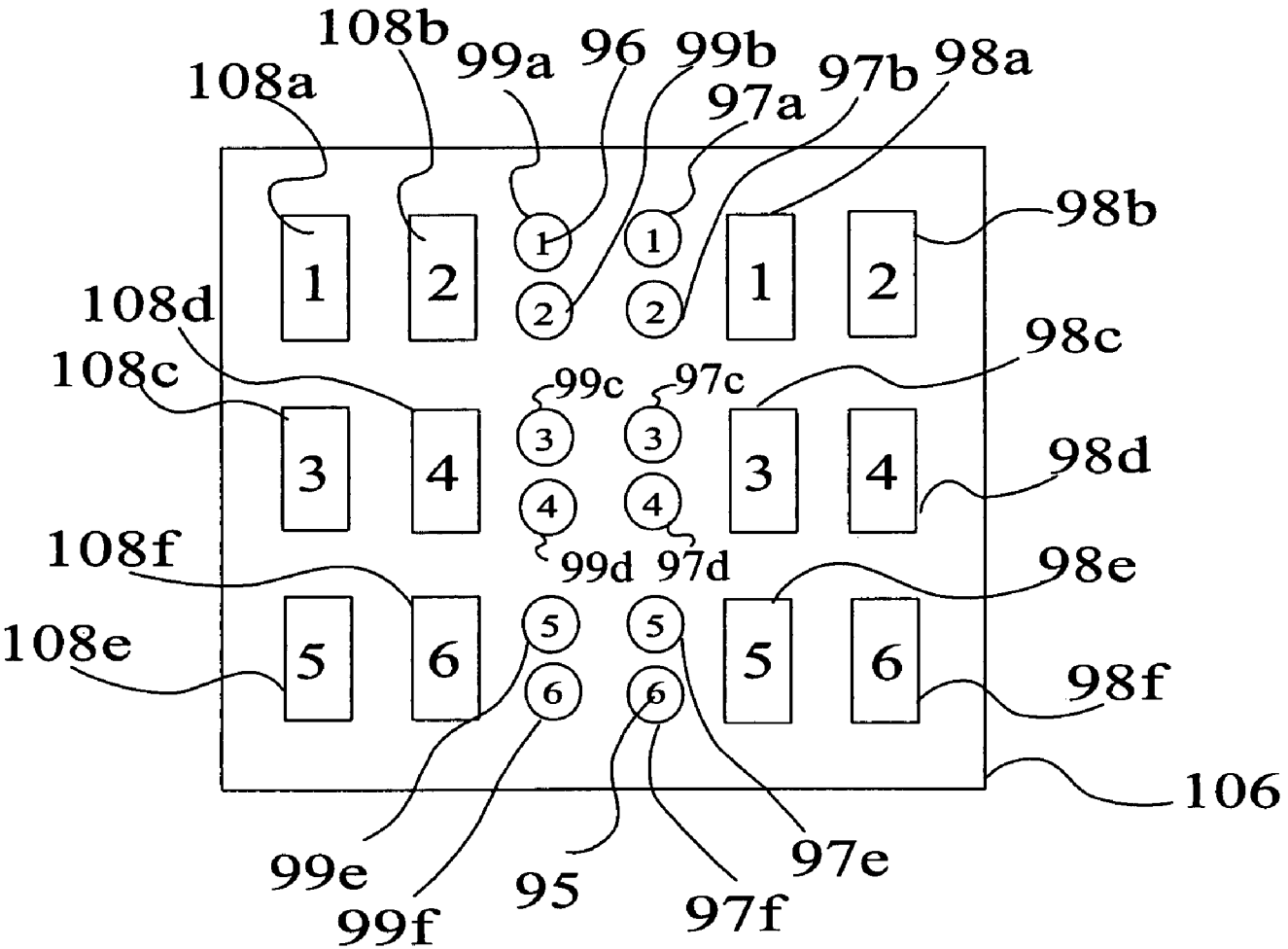
FIG. 2 shows one embodiment of the layout shown at 106 shown in FIG. 1.
Figure 8A:
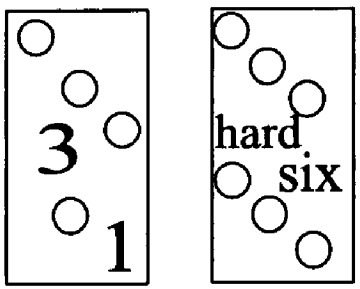
FIG. 8*a* shows two cards of an alternate type usable when one card represents two dice.
Figure 8:
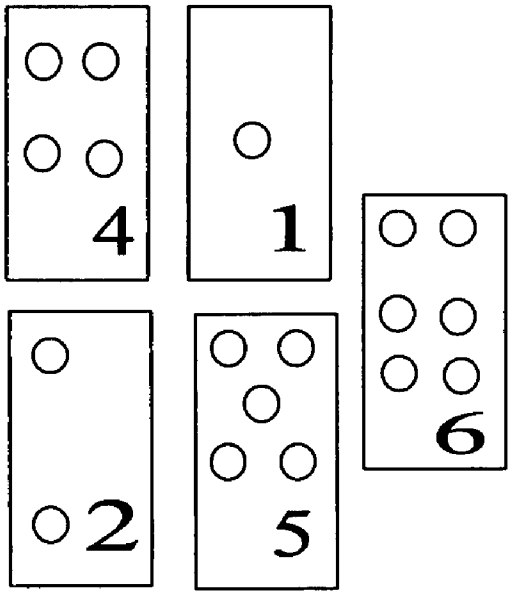
FIG. 8 shows a set of six numbered cards having dots and numeric displays of quantity.

FIG. 2 shows one method of defining the card holding location 106. In this embodiment, there are marker spaces 99*a*-99*f* and 97*a*-97*f* which serve to hold markers 96 and 95 respectively. These markers 95 and 96 are placed on one of the marker spaces 99*a*-99*f* and on one of the marker spaces 97*a-f* before the deal. Up to six cards may be dealt to locations 108*a*-108*f* and 98*a*-98*f*. The card on the space with a number corresponding to the marker 95 and 96 is the selected card and the two cards are added to determine the value of the resulting deal. These cards are shown in FIG. 8.

Figure 7:
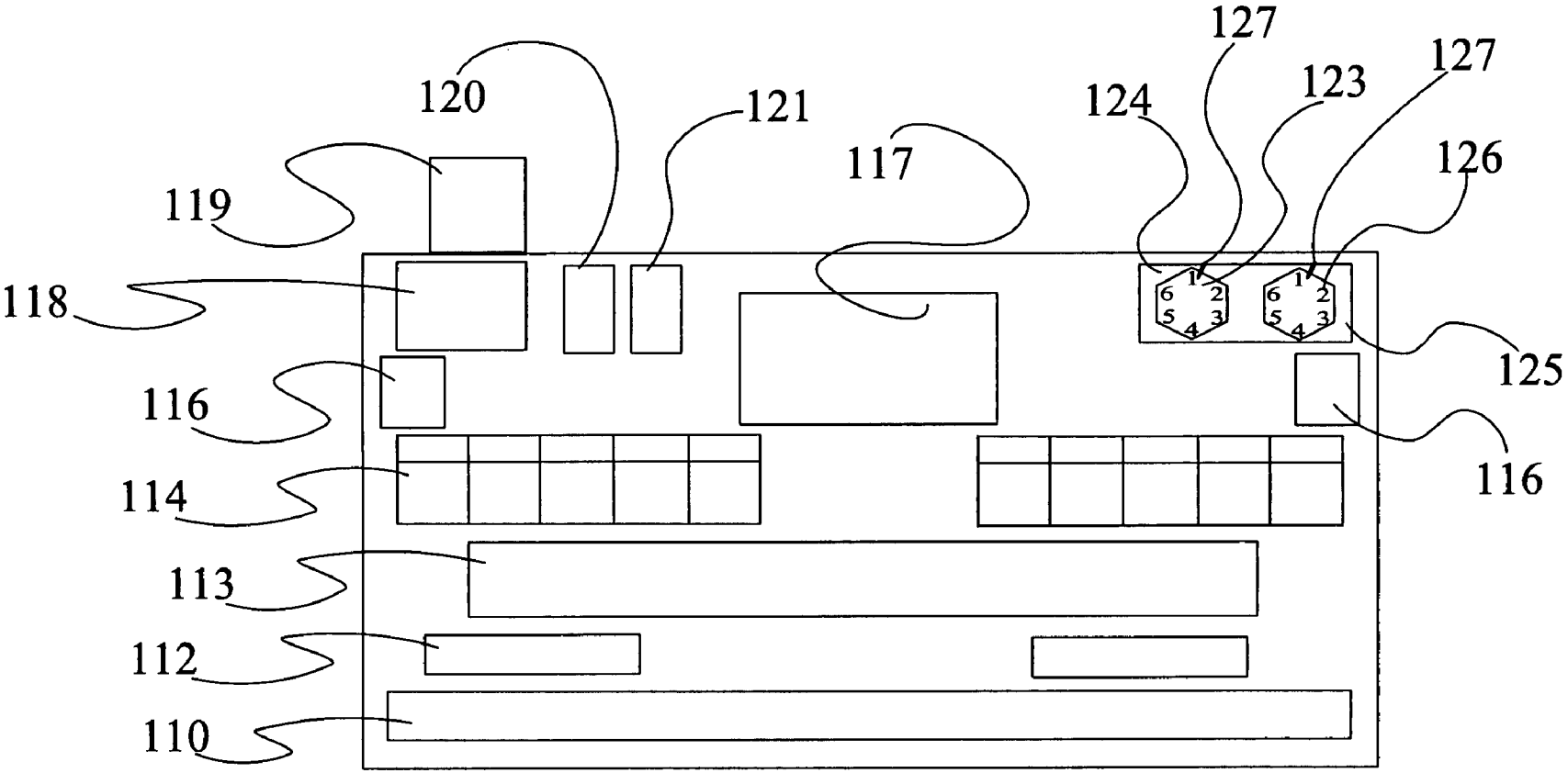
FIG. 7 shows a layout which includes an alternate dice means.

In the example shown, marker 96 marks space 99*a* and marker 95 marks space 97*f* so that cards (not shown) dealt to card location 108*a* and a card (not shown) dealt to card location 98*f* would be the selected cards. In this example if a "3" was dealt to 108*a* and a "4" dealt to location 98*f*, then the total of 7 is the resulting roll or deal. By way of alternate example, if card 3 is dealt to location 108*a* and another card 3 is dealt to location 98*f*, in this example of the layout, the total would be a 6 "hardway" or a "hard six". The space 99*a-f* may be selected by a method such as rolling a dice, spinning a wheel as shown in FIG. 7 or by a random number generated or another type. For a wheel as in FIG. 7 a ball may be used as in a roulette table or a pointer 127 may be used.

Figure 3:
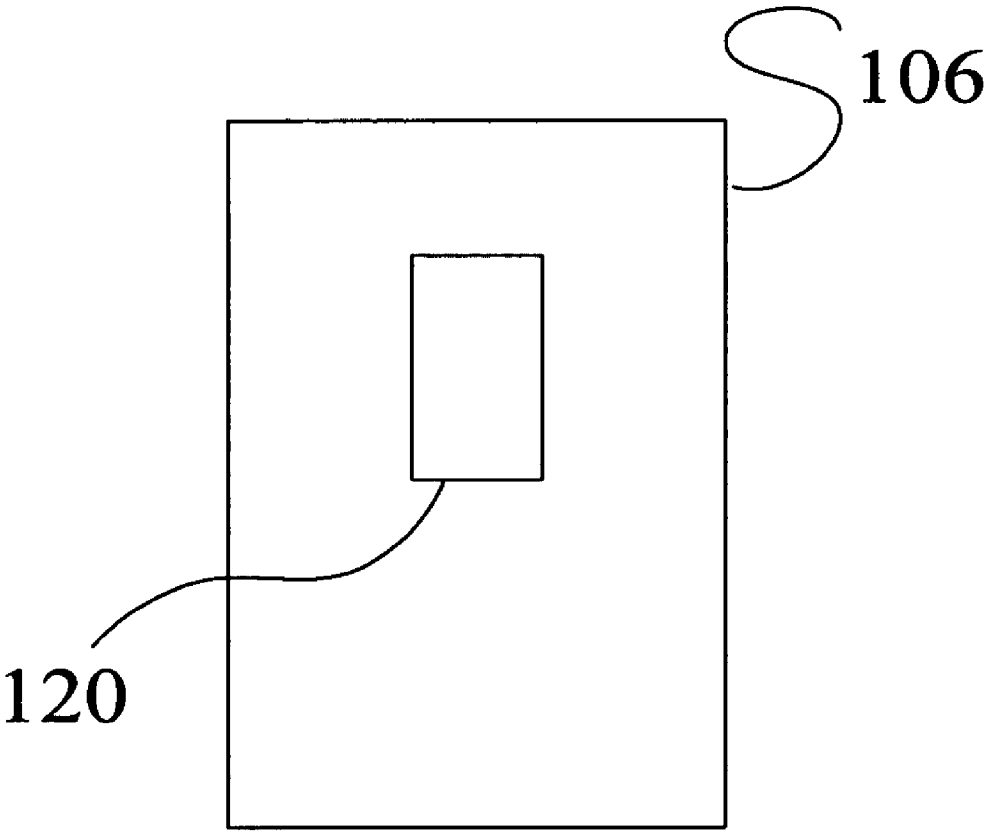
FIG. 3 shows one embodiment of the layout shown at 106 for FIG. 1.

If 36 cards are simultaneously shuffled, reflecting each of the 36 possible outcomes with two six sided dice, then the outcomes may be dealt to a first single location 120 shown on FIG. 3 as one alternate embodiment of the card holding location 106. These cards are shown in FIG. 8*a*.

Figure 4:
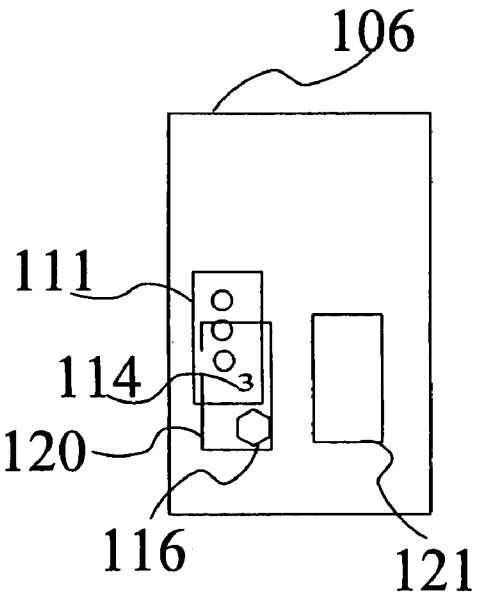
FIG. 4 shows one embodiment of the layout shown at 106 for FIG. 1.

If two cards are dealt to get the total, but the user does not preselect the space to which it is dealt, the layout shown in FIG. 2 can be replaced with the layout shown in FIG. 4 where there is a first single location 120 and a second single location 121 which will receive one of the six sided dice numbers.

The card holding locations may work in several different manners in accordance with the disclosure herein. Six locations 108*a-f* are shown so that six different card dice rolls may be displayed and one of those may be pre-selected with a marker 96 on spaces 99*a-f*. Where two sets of cards are used, each having the numbers sequentially on through six, there may be a second set of six locations 98*a-f* to display the next six cards. The same marker 96 for both groups of locations (108*a-f* and 98*a-f*) or two different markers 95 and 96 for locations 108*a-f* and 98*a-f*, respectively, may be used to get the same statistical result.

Similarly, a card may be turned up either according to its location after it is dealt, by being specified by the user or, as set forth above in the preferred embodiment, the location may be selected when the cards are dealt by a second random number generator at location determining device. It should also be noted that while locations for all six cards are shown, only two cards need be dealt to card holding locations for the first roll, if dealt randomly, to allow for user selection to play a roll in the random outcome.

The game may be viewed as played using 6 cards numbered 1, 2, 3, 4, 5, 6 or 36 cards showing every possible combination of the dice or a set of cards representing the numbers possible on a roulette wheel. A randomizing means (the random number generator) is then used in order to select which of the cards will be turned up.

One example of how this could work is as follows: 6 cards are dealt to spaces numbers 1-6 (98-*f*); 98*a* being 1, 98*b* being 2, 98*c* being 3; 98*d* being 4; 98*e* being 5; and 98*f* being 6). If six sided dice is roller. The number on the dice decides which card is selected. (E.g. if a 3 card us on 98*b* and a 2 is rolled on the dice, the first number (on the dice if using 2 cards to obtain sums or the entire roll if the card represent the sum of the roll) is a 3.

Other methods are described below.

One way to determine which card is turned up is to have the player select a space before or after the cards are displayed. Another method would be to deal the cards to at least two spaces use a random number generator CE-9. to roll at least one dice to determine which of the spaces was displayed.

A random number generator may be utilized in order to display the numbers in the spaces provided in the form of wheels, cards or dice in the layouts embodied herein.

Where 36 combinations are used, up to 36 cards could be dealt. The player could then pick from these 36 combinations using whatever randomizing method was desired (cards, wheels, dice, electronic random generator, or combinations thereof.

If 6 cards are dealt for each of the two dice, the dice would occupy 6 spaces for each of the two dice represented. The player could select the spaces at random, before the roll to determine the location of the roll or could use another random method for determining the spaces to be selected after the roll. Rolling a six sided dice and picking the card or a space corresponding to the number on the dice would be one method. To separate the first and second rolls, the dice could have different colors corresponding to a first color used for the first location for the first 6 cards representing the possible outcomes (1-6) of the first dice and a second color used for the second location for the second 6 cards representing the possible outcomes (1-6) for the second dice if 2 dice was used with six sided dice, six different color (with associated shapes) could be used.

The cards would be reshuffled for each new "deal". This is not required in all embodiments because only one randomizing event is required.

A shuffle machine or hand dealt cards could be used on this or on a roulette table. For either dice or roulette, the location could be selected using a wheel such as that shown in FIG. 7 for selected up to six spaces used in conjunction with the card mechanism (cards dealt to separate spaces) in order to increase interest in the game.

All 36 cards (38 for roulette with two zero spaces (single zero and double zero) could be dealt or the player could select from only 6 of the 36 (38 for roulette) cards dealt using a randomizing method such as the dice (discussed above), six other cards, electronic random number generators or wheels shown in FIG. 7. For either, the wheel could show up to all 36 (38 for roulette) combinations and which selected space would be used.

Since there may be 38 possible spaces for traditional games and because it may be desirable to use dice with only six sides (or less) or wheels with less than 38 possible spaces (such as the 6 sided wheels shown in FIG. 7), the spaces receiving cards may receive less than all of the cards (six of 36, for example) and the space for the one card selected may be selected by a random selection means (wheel, dice, electronic random number generator or the like) even though other possible numbers would be possible were all the combinations dealt.

While a six sided dice is used in the example, a two sided dice could be used to determine between two or more spaces since the addition of a separate selection means for selecting randomly dealt numbers is only a method for taking the selection process away from the dealing machine or hand dealt cards and, theoretically, is not less random than allowing the user to pick a space before or after the deal and before the cards are displayed according to the user's personal choice.

In any scenario, a "boxman" displays at least two cards (these cards may appear as electronic pictures on spaces so provided or may be cards from a shuffle machine) on a display location. They may be placed face up or face down on the display location. Then a randomizing dice or other randomizing means selects from the at least two spaces to determine the card selected.

Once that card is revealed all appropriate transactions are negotiated. The cards are put back in the continuous shuffler or shuffled by hand and the game continues.

For a Roulette table, a shuffle machine with a deck of 38 cards (representing 1-36, 0, and 00) (or 37 cards representing 1-36 and zero) and a randomizing means to select a card may be used. The randomizing means may be a spinner with indicators (numbers as shown in FIG. 7, although colors or shapes may also be used) and after dealing at least 2 cards face down on the layout in the boxes (display locations) provided, one of the spaces is selected to display the "roll" or "spin" represented by the dealt dice. If six spaces are used, six numbers on the spinner shown in FIG. 7 would be used. If four spaces were used, only 4 number on the spinner could be used. If three spaces were used, only 3 numbers need appear on the spinner, although these numbers could be repeated equally to allow for a random selection (the chance of a two appearing with two of each number 1-3 would be the same as the chance of a two appearing with one of each number 1-3). Numbers, colors or shapes displayed by the random number generator are indicators which would be used to associate the card to be selected from locations bearing those indicators.

Whatever indicator is selected, that corresponding card is revealed to determine the outcome of the deal (typically 1-6 or 1-36, 0 and 00).

While user choice, spinners and dice are discussed, a second set of cards could be used to the same effect. The key is to randomly pick a location for each roll in addition to the randomization inherent in the "shuffle" of the cards.

For either roulette or dice games all possible combinations may be shown utilizing the random chance of each outcome. This can be done with multiple dice cards (two sets of cards, each representing the rolls of dice) or 36 dice with craps. For Roulette, the zero and double zero require that more cards be used, usually 38.

Also, a single "roller" may select the card to turn up or it may be selected by majority vote of multiple players. The selection process may occur before every roll or may be made once and apply to all deals until a terminating event occurs.

The purpose for having the determination as to which spot would have the card to be turned up before the cards were dealt would be to prevent the possibility of any marking of the cards interfering with the random of nature of the game.

A single card may be dealt from the top of the deck or at a random location determined by a dealing machine. In a situation where each of the card dealing machines 101 through 104 deals out a single card from 36 cards, this one location 120 will display a card corresponding to one of the rolls of the two dice (Examples are shown in FIG. 8*a*). The cards may be marked sequentially from two single dots (a "2") to two six dots (a "twelve") so that all possible 36 combinations, of two six sided dice are shown. Where multiple decks are used, a wild card may be included. In one example, using traditional dice, instead of one set of 36 cards, two (or more) sets of 36 cards could be used. The statistical odds of any roll would be the same (one in 36). One of the cards, however, could bear a special character (not shown) such as a dollar ("$") sign. The odds of this card appearing would be one in 72 (in this example) and a bonus could be paid on it's appearance or on its appearance at a particular location (e.g. if it appeared at 98*f*) and the spinner (FIG. 7) selected 6 when spun. This bonus could be the subject of an additional wager or could be a bonus on the wagers within the game. Any number of "wild cards" can be used with any number with regular cards to allow for statistics to be manipulated FIG. 4 shows where decks of six cards are used. A card is dealt to space 120 for the first card and space 121 for the second card and the spaces are added for a total. This is shown where the space 120 has a sensor 116 to read a numeric or electronic number marker 114 on the card 111 (here a three). The technique described above dealing with the choice of one card from multiple dealt cards may be used in these embodiments.

Figure 5:
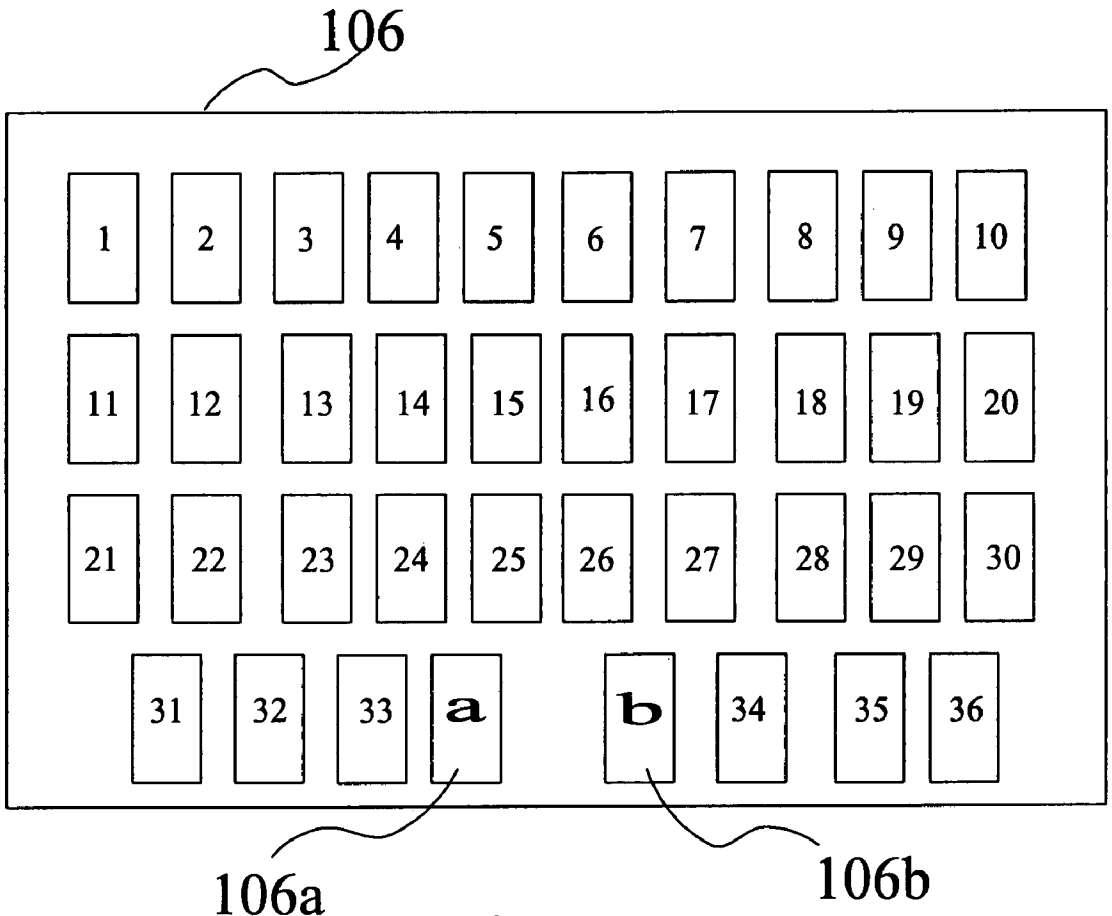
FIG. 5 shows one embodiment of the layout shown at 106 for FIG. 1.

FIG. 5 shows a modification of the display shown in FIGS. 3 and 4 where all combinations (36 in a typical two six sided dice combination) are dealt. The player makes a selection of which space is used according to the rules specified. In this layout the user could select one of the 36 numbers until a 7 was displayed (high low craps). If more than 36 numbers are used extra spaces, here 106*a* and 106*b*, may be provided to receive these cards. These extra spaces 106*a* and 106*b* may, alternatively, be used to accept cards which are terminating events so that the terminating event may change in accordance with the deal to these spaces. For example, if a six and a ten were dealt to spaces 106*a* and 106*b*, the deal could terminate upon turning up a six or ten. The player "choice: could be made randomly with equal effectiveness.

In addition to utilizing cards in this technique, a random number generator may be utilized in order to display the numbers in the spaces provided in the form of cards or dice in the layouts embodied herein. In the example shown in FIG. 5, blank cards could cover the spaces displaying the numbers selected which could be sequentially lifted according to the choice of the player.

Figure 6:
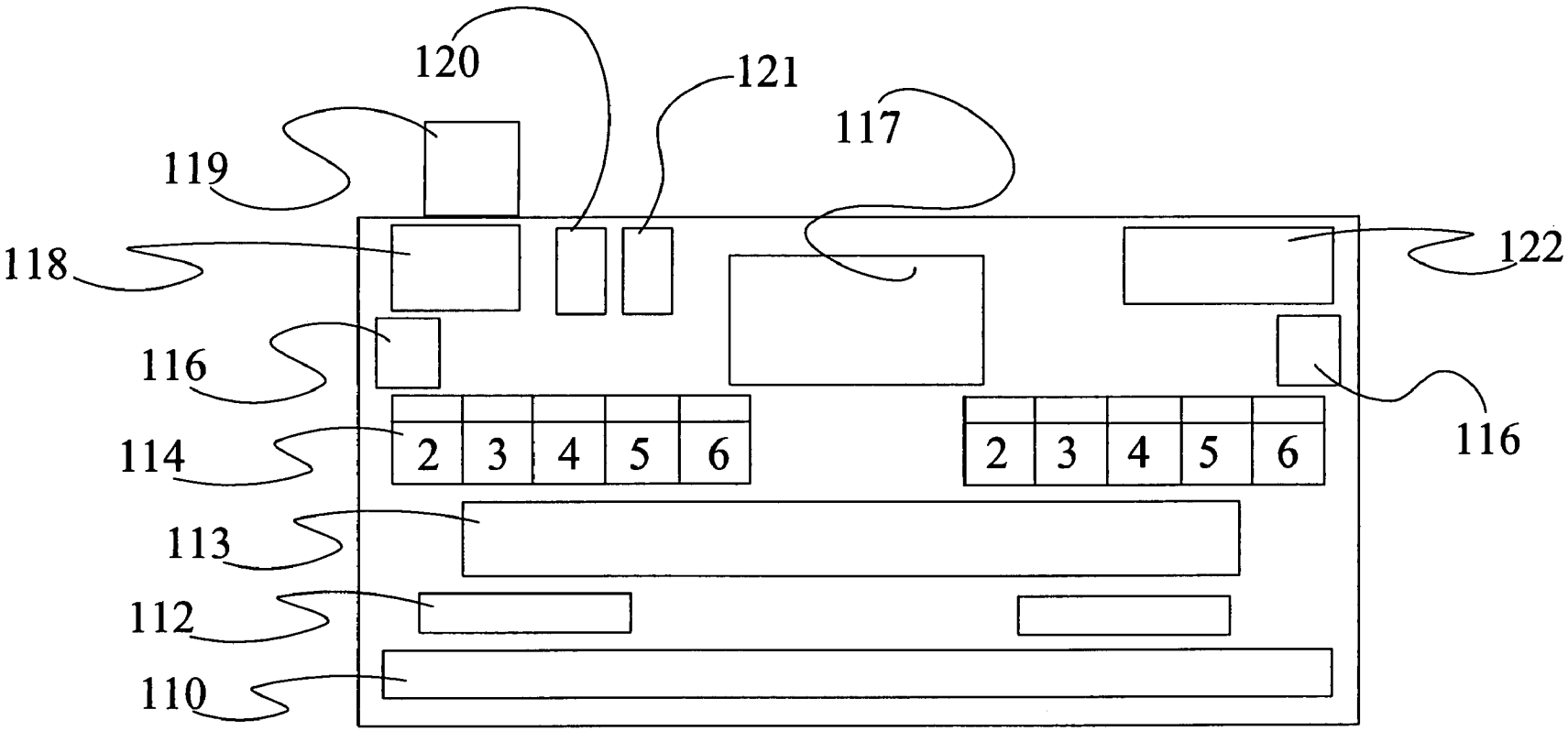
FIG. 6 shows a layout for a single dealing machine.

Since the invention may be played with a single dealing machine, FIG. 6 shows an embodiment where a single dealing machine 118 deals two cards numbered 1-6 to a first location 120 and a second location 121 in order to determine a roll. A shuffling machine 119 of the type known in the art is provided to deal one deck of numbered cards while the other decks are dealt by the dealing machine 118. The dealer stands behind a chip rack 117. In this embodiment, a craps type game is played having a pass line 110, a don't pass/don't come location 115, a come line 113 as well as a location for field type bets 112 and odds wagers 114. The exact layout may be identical to a craps layout with the addition of the dealing machines 118, shuffling machine 119 and card display areas, here locations 120 and 121. A tracking display 122 showing the total of the current roll or the rolls in the series of the rolls before a terminating event may be provided. This display 122 may obtain the total of the cards through markings on the cards readable on the display areas 120 and 121 as described in more detail in reference to FIG. 4 above.

A first wager location for accepting a wager on at least one statistical event associated with the random generation of dice tolls according to a set of rules based on statistical odds is required for most games of this type. Typically this is a "come" location 110.

FIG. 7 shows another alternate embodiment based around the general display shown in FIG. 6 wherein the dice rolls may be obtained through alternate dice means 123 and 126, here six sided wheels 123 and 126, wherein the roll is determined by the numbered positions on the wheels relative to pointers 124 and 125. In this way, the card dealing mechanism and card holding locations are used in conjunction with another mechanism to increase the interest in the game and to accelerate play.

Utilizing the locations for six cards (108*a-f* and 97*a-f*) and the locations for six markers (99*a-f* and 97*a-f*), it can be seen that the location for the six markers can be removed and replaced with the random number generator, in this case the spinners (124 and 125) so that after the six cards are dealt, the random number is generated (the spinner is spun) and the number on the spinner corresponding to the number on the card location (the location with the corresponding number) will be location from which the card is selected for that portion of the deal. Therefore, if on location number two 108*b*, a "six" card is displayed, then if the spinner lands on "2", the "six card" is selected. I.E. the spinner spins to two, then the card on the two location is turned up and that is either half or all of the spin according to the rules of the game (Either two cards added together to achieve a total (two six sided dice in craps) or one card shows the total of two six sided dice (36 cards required)).

It can be seen that less than all of the cards can be dealt and while six spaces are taught in the preferred embodiment from which to select from, it can be as few as two or as many thirty-eight for roulette or more for alternate versions of the game.

One of the benefits of this is that more cards can be available than on a typical roulette table but a typical roulette wheel can still be used because only thirty-eight spaces are needed. Likewise, a more than six sided dice of any other type could be utilized but a six sided dice could be rolled because only six spaces were available to determine which six cards, thereby allowing for the odds to be varied and the payouts to be increased.

The spinner shown in FIG. 7 is utilized in this example, but it can easily be seen that this can be replaced with six cards, a six sided dice, a larger wheel with more numbers or six numbers repeated over and over again, or any other electronic or mechanical random number generator having numbers corresponding with the spaces and could even include a location for some additional benefit. By way of example, if there were only five spaces receiving cards but there was still a six place spinner of the type shown in FIG. 7, then a sixth card could be dealt to the sixth place and that could give some special prize to the player. This could be accomplished by providing a special prize or benefit only if the special card from the deck was dealt to one or more particular randomly selected space. By way of example, if a card with a special indicator (e.g. item 116 shown on FIG. 4) was dealt to the $6^{th}$ space (e.g. 108*f*) and the $6^{th}$ space was selected by the random number generator, then the prize could be won or won if there was another wager. Associating a prize or special benefit or bonus the different special indicators could be according to any statistically acceptable method known in the art.

FIG. 8 shows a set of six numbered cards having dots and numeric displays of quantity for the numbers one through six.

FIG. 8*a* shows two cards of an alternate type usable when one card represents two dice. By way of example, one card shows a 3-1 combination to make 4 and the other card shows a 3-3 combination to make a "hard six".

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

The invention claimed is:

1. A method of playing a wagering game with at least a first deck of cards comprising:

providing at least a first physical deck of cards;

providing a table means for holding cards and wagers, the table having:

a first group of card holding locations, the group comprising a first card holding location and at least a second card holding location, the card holding locations each adapted to receive a card from the at least a first deck of cards; and a plurality of wager locations for receiving wagers;

accepting at least one wager on the plurality of wager locations having a payout based on a predetermined statistical event;

providing at least a first random selection means for randomly selecting cards from the at least a first deck of cards;

randomly selecting cards from the at least a first deck of cards with the at least a first random selection means and dealing the cards to the card holding locations of the first group of card holding locations;

providing at least a second random selection means for selecting a card holding location from the first group of card holding locations;

randomly selecting a card holding location with the at least a second random selection means, the result being a selected card holding location within the first group and non-selected card holding locations within the first group;

including in play the card associated with the selected card holding location within the first group and eliminating from play all cards associated with non-selected card holding locations within the first group, satisfying wagers if the selected card matches the predetermined statistical event.

2. The method of claim 1, wherein the at least a first deck of cards includes a card for each available combination of a roll of a pair of six sided dice, wherein each card has a representation of the corresponding available combination.

3. The method of claim 2, wherein the at least a second random selection means comprises a spinning wheel with results corresponding to individual card holding locations of the first group.

4. The method of claim 2, wherein the at least a second random selection means comprises at least one die with results corresponding to individual card holding locations of the first group.

5. The method of claim 2, wherein the at least a second random selection means comprises at least a second deck of cards with results corresponding to individual card holding locations of the first group.

6. The method of claim 1, wherein the at least a first deck of cards includes a card for each number on a roulette wheel, wherein each card has a representation of the corresponding number on the roulette wheel.

7. The method of claim 1, wherein the table further comprises a second group of card holding locations, the group comprising at least a third card holding location and at least a fourth card holding location, the card holding locations each adapted to receive a card from at least a second deck of cards, the method further comprising:

providing at least a third random selection means for randomly selecting cards from the at least a second deck of cards;

randomly selecting cards from the at least a second deck of cards with the at least a third random selection means and dealing the cards to the card holding locations of the second group of card holding locations;

providing at least a fourth random selection means for selecting a card holding location from the second group of card holding locations;

randomly selecting a card holding location with the at least a fourth random selection means, the result being a selected card holding location within the second group and non-selected card holding locations within the second group;

including in play the card associated with the selected card holding location within the second group and eliminating from play all cards associated with non-selected card holding locations within the second group.

8. The method of claim 7, further comprising satisfying wagers if the selected card within the first group and the selected card within the second group, individually or collectively as determined by a set of rules, match the predetermined statistical event.

9. The method of claim 8, wherein the at least a first and at least a second deck of cards includes at least one card for each value of a roll of a six sided die, wherein the at least one card has a representation of the corresponding value.

10. The method of claim 9, wherein the at least a second and at least a fourth random selection means each comprise a spinning wheel with results corresponding to individual card holding locations of the first and second group respectively.

11. The method of claim 9, wherein the at least a second and at least a fourth random selection means each comprise at least one die with results corresponding to individual card holding locations of the first and second group respectively.

12. The method of claim 9, wherein the at least a second and at least a fourth random selection means each comprise at least a third and at least a fourth deck of cards with results corresponding to individual card holding locations of the first and second group respectively.

13. The method of claim 7, wherein the predetermined statistical event is determined from the statistical events from the group consisting of 1) a traditional craps game, 2) a Four The Money game, 3) a high roller of the month game, 4) high low craps, 5) a roulette game, or 6) combinations thereof.

14. The method of claim 13, further comprising at least one special card, wherein the at least one wager comprises presenting a special statistical event with an enhanced payout based on the selection of the least one special card.

15. The method of claim 14, wherein the special statistical event is from the group consisting of (1) allowing the player to pick any number from a predetermined minimum and a predetermined maximum of card values in the at least a first and at least a second decks of cards, the number defining the value of the at least one special card, (2) providing a multiple payout, (3) providing a special payout not related to a wager on the occurrence of the special card, (4) providing a special payout related to a wager on the occurrence of the special card, (5) triggering an event to select at random an additional pay out from a group of payouts, and (6) combinations thereof.

16. The method of claim 14, wherein the special card also bears a number between a predetermined minimum and a predetermined maximum of card values in the at least a first and at least a second deck of cards.

17. The method of claim 14 further comprising, associating a separate prize with the special card and paying a bonus when the special card is the selected card within the first group or the second group.

* * * * *

UNITED STATES PATENT AND TRADEMARK OFFICE

CERTIFICATE OF CORRECTION

PATENT NO. : 7,527,265 B1
APPLICATION NO. : 11/173570
DATED : May 5, 2009
INVENTOR(S) : Lyle Berman It is certified that error appears in the above-identified patent and that said Letters Patent is hereby corrected as shown below:

On the title page,
Section entitled Related U.S. Application Data

| Item (60) | **PTO** | **Should Read** |
|---|---|---|
| | "Division of application No. 09/975,907, filed on Oct. 12, 2001, and a continuation-in-part of application No. 09/975,907, filed on October 12, 2001, now Pat. No. 6,913,262." | -- Division of application No. 09/975,907, filed on Oct. 12, 2001, and a continuation-in-part of application No. 09/975,907, filed on October 12, 2001, now Pat. No. 6,913,262, which claims priority to U.S. Provisional Application No. 60/240,019, filed on October 12, 2000. -- |

Signed and Sealed this
Sixteenth Day of August, 2011

David J. Kappos

David J. Kappos
*Director of the United States Patent and Trademark Office*